US007125292B2

(12) United States Patent
Horiuchi et al.

(10) Patent No.: US 7,125,292 B2
(45) Date of Patent: Oct. 24, 2006

(54) CONNECTOR WITH RETAINER HAVING MEANS FOR PREVENTING INCLINATION OF THE FRONT PART

(75) Inventors: Masaya Horiuchi, Yokkaichi (JP); Toshikazu Sakurai, Yokkaichi (JP); Satoshi Suda, Wako (JP)

(73) Assignees: Sumitomo Wiring Systems, Ltd.(JP); Honda Motor Co., Ltd.(JP)

( * ) Notice: Subject to any disclaimer, the term of this patent is extended or adjusted under 35 U.S.C. 154(b) by 0 days.

(21) Appl. No.: 11/252,156

(22) Filed: Oct. 17, 2005

(65) Prior Publication Data

US 2006/0084326 A1 Apr. 20, 2006

(30) Foreign Application Priority Data

Oct. 20, 2004 (JP) ..... 2004-305833

(51) Int. Cl.
*H01R 13/514* (2006.01)

(52) U.S. Cl. ..... 439/752

(58) Field of Classification Search ..... 439/752, 439/595, 596

See application file for complete search history.

(56) References Cited

U.S. PATENT DOCUMENTS 5,651,703 A * 7/1997 Sasai ..... 439/752
5,800,216 A * 9/1998 Okada ..... 439/752
5,897,402 A * 4/1999 Sasai et al. ..... 439/752
5,934,946 A * 8/1999 Nakamura ..... 439/752
5,980,333 A * 11/1999 Nakamura et al. ..... 439/752
6,497,591 B1 12/2002 Fujita
6,500,031 B1 * 12/2002 Morita et al. ..... 439/752
6,599,154 B1 7/2003 Sakurai et al.
2003/0176114 A1 * 9/2003 Nankou et al. ..... 439/752

FOREIGN PATENT DOCUMENTS

JP 2002-170621 6/2002

* cited by examiner

*Primary Examiner*—Tulsidas C. Patel
*Assistant Examiner*—Vladimir Imas
(74) *Attorney, Agent, or Firm*—Gerald E. Hespos; Anthony T Casella

(57) ABSTRACT

A connector has a retainer (6) with a housing lock (4) engageable with a housing (3) and a terminal lock (5) cantilevers forward from a bottom side of the housing lock (4) to lock female terminal fittings (1). Restricting portions (7) are formed on a surface of the terminal lock (5) to face the housing (3). The restricting portions (7) can contact bottom end surfaces (3A) of the opposite side walls of the housing (3) along the width direction, thus preventing the terminal lock (5) from entering cavities (2) to hinder the insertion of the female terminal fittings (1) when the female terminal fittings (1) are inserted into the cavities (2).

9 Claims, 9 Drawing Sheets

CONNECTOR WITH RETAINER HAVING MEANS FOR PREVENTING INCLINATION OF THE FRONT PART

BACKGROUND OF THE INVENTION

1. Field of the Invention

The invention relates to a connector with a retainer for retaining one or more terminal fittings.

2. Description of the Related Art

Japanese Unexamined Patent Publication No. 2002-170621 discloses a connector with a housing and a retainer that is obliquely insertable into the housing. The retainer has a housing lock that is engageable with a side surface of the housing and a terminal lock that cantilevers forward from the housing lock to lock terminal fittings in cavities of the housing. The retainer is movable obliquely from a partial locking position to a full locking position.

An external force may be exerted on the retainer at the partial locking position and may rotate the retainer about the housing lock. Thus, the retainer could move to an oblique posture at the partial locking position, and part of the terminal lock may enter a cavity sufficiently to hinder insertion of the terminal fittings. As a result, the original partial locking function is lost.

The invention was developed in view of the above problem and an object thereof is to improve the reliability of partly locking the retainer.

SUMMARY OF THE INVENTION

The invention relates to a connector with a housing formed with at least one cavity for receiving at least one terminal fitting. The connector also has a retainer with a housing lock engageable with the housing and at least one terminal lock to lock the terminal fittings. The retainer is movable between a first position for permitting the insertion and withdrawal of the terminal fittings into and from the housing and a second position for causing a part of the terminal lock to enter the cavities to lock the respective terminal fittings. A restriction is formed at one of facing portions of the terminal lock and the housing. The restriction can engage releasably with the housing when the retainer is at the first position for restricting an inclination of the part of the terminal lock in a direction to enter the cavities.

An external force may be exerted on the retainer when the retainer is at the first position, and may act in a direction to rotate the retainer about the housing lock. However, the restriction on facing portions of the terminal lock and the housing prevents entry of the terminal lock into the cavities when the retainer is at the first position. As a result, the retainer can be locked more reliably at the first position without hindering insertion of the terminal fittings.

The terminal lock preferably is cantilevered and projects substantially forward from the housing lock.

The retainer preferably is movable relative to the housing between the first position and the second position along a direction oblique to an inserting direction of the terminal fittings.

The restriction preferably projects from the terminal lock and substantially contacts the housing when the retainer is at the first position.

The housing preferably is recessed to form an escape for receiving the restriction when the retainer is moved towards or to the second position.

Various members can be the restriction for the retainer. According to a preferred embodiment, the restriction escapes by moving the retainer from the partial locking position to the full locking position in a direction oblique to the inserting direction of the terminal fittings.

The housing preferably comprises two retainer mounting surfaces to engage with respective side plates of the retainer to mount the retainer.

A peripheral wall preferably projects substantially along each retainer mounting surface and the retainer and the housing are positioned by holding the side plates in contact with portions of the peripheral walls.

The retainer preferably is pushed while upper edges of the side plates move onto respective locking edges to widen the spacing between the side plates. The retainer is pushed until the side plates contact guide surfaces.

Restricting slants preferably are provided on the housing for preventing the retainer from inadvertently moving to the second position. The slants contact a facing edge of the side plate when the retainer is at the first position.

One of the housing and the retainer preferably has a locking edge and the other has locking recesses. Thus, the locking edges engaged the locking recesses when the retainer is at the first position to prevent the disengagement of the retainer from the connector housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 4:
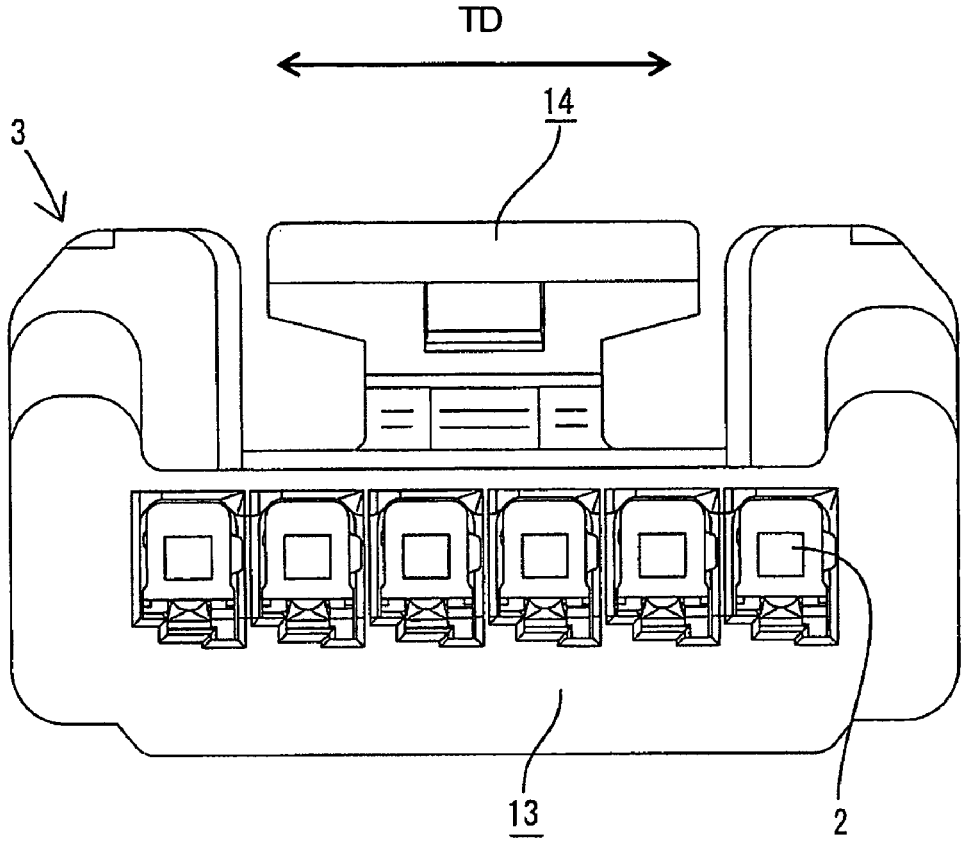
FIG. 4 is a rear view of the connector housing.
Figure 5:
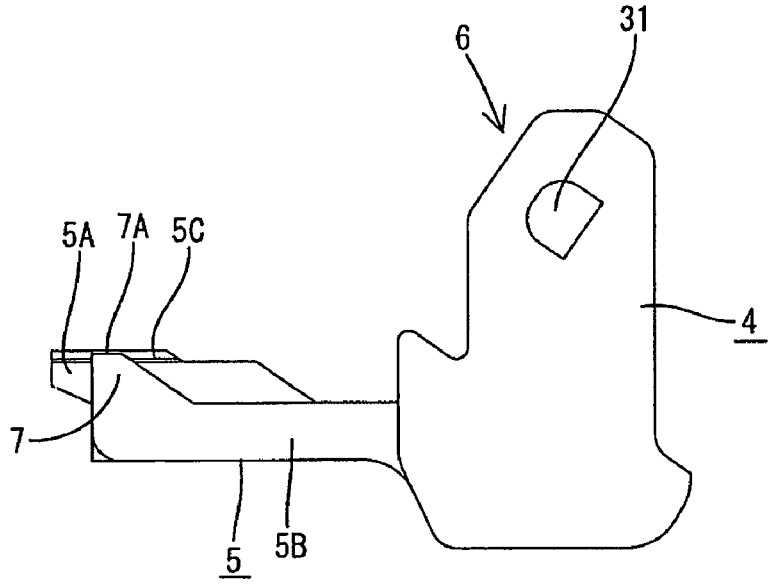
FIG. 5 is a side view of a retainer.
Figure 6:
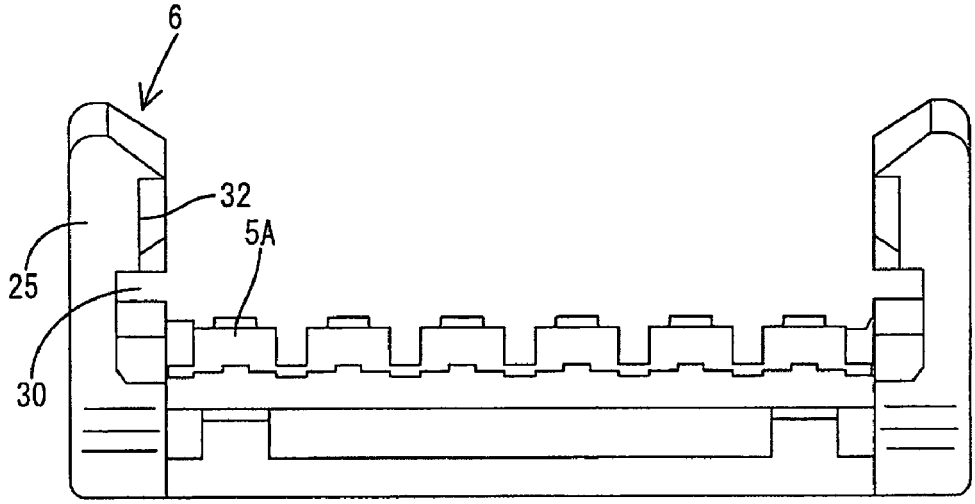
FIG. 6 is a rear view of the retainer.
Figure 7:
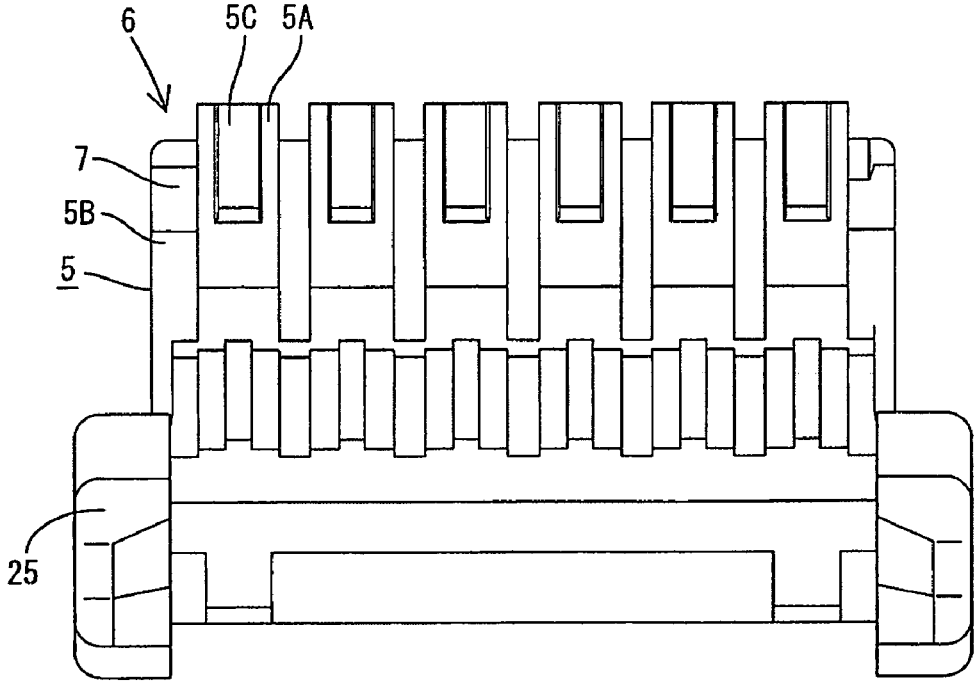
FIG. 7 is a top view of the retainer.
Figure 10:
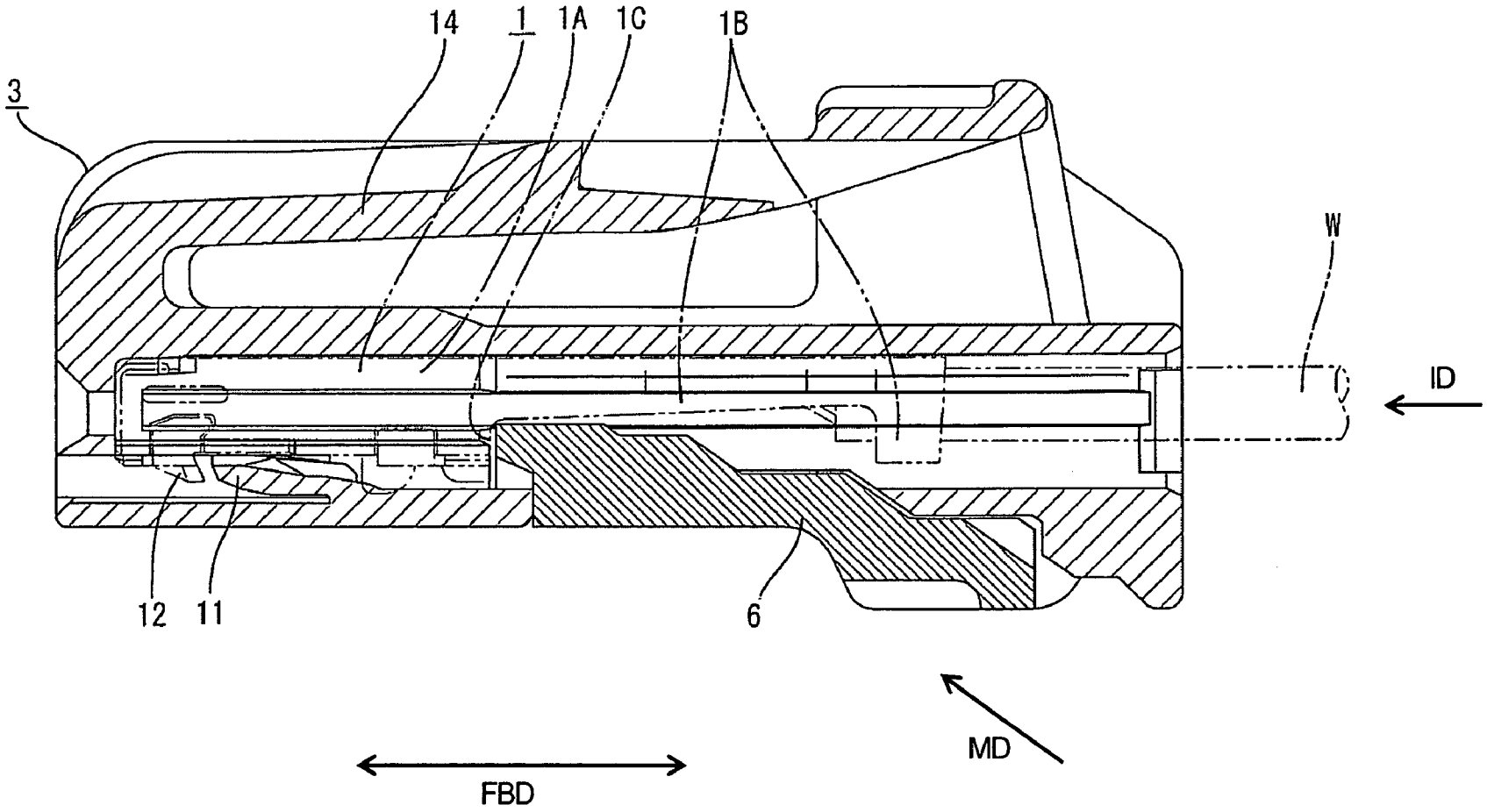
FIG. 10 is a side view in section showing the state where the retainer is held at the full locking position.

A connector according to the invention has female terminal fittings 1 secured to ends of wires W. The female terminal fittings 1 are accommodated in a female housing 3 and are locked by a retainer 6 as shown in FIGS. 4 and 10. An end of the connector (left side e.g. in FIG. 11) to be connected with a mating connector (not shown) is referred to in the following as the front. The terms top and bottom are used herein to provide a convenient frame of reference, but are not intended to imply a required gravitational orientation.

Each female terminal fitting 1 has a substantially rectangular tube 1A that is configured for connection with a male terminal fitting (not shown). Barrels 1B are provided behind the rectangular tube 1A for crimped, bent or folded connection with the end of the wire W. A locking piece 12 is formed near the front of the bottom surface of the rectangular tube 1A and a jaw 1C is formed at the rear edge of the bottom surface of the rectangular tube 1A.

Figure 2:
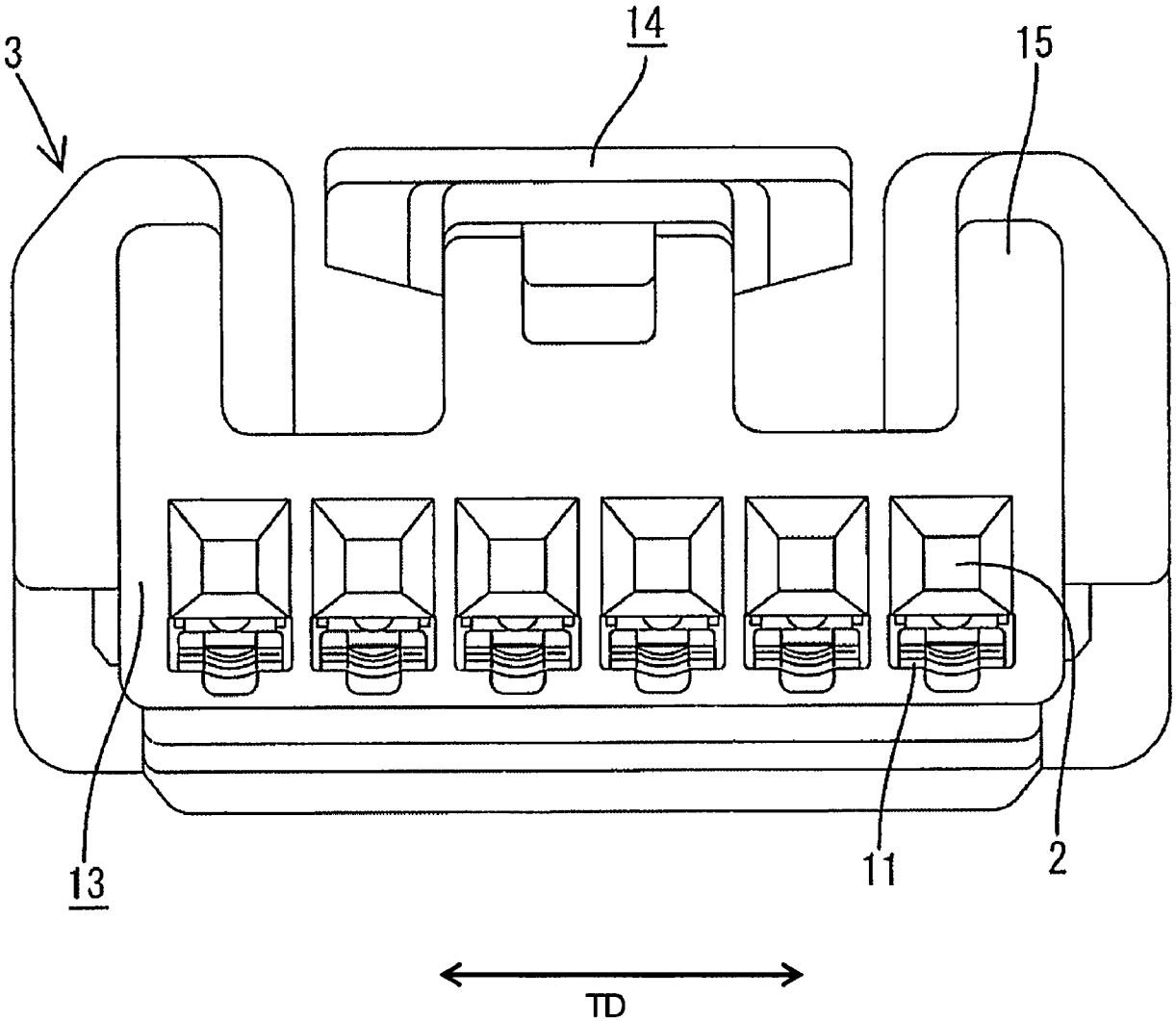
FIG. 2 is a front view of the connector housing.
Figure 3:
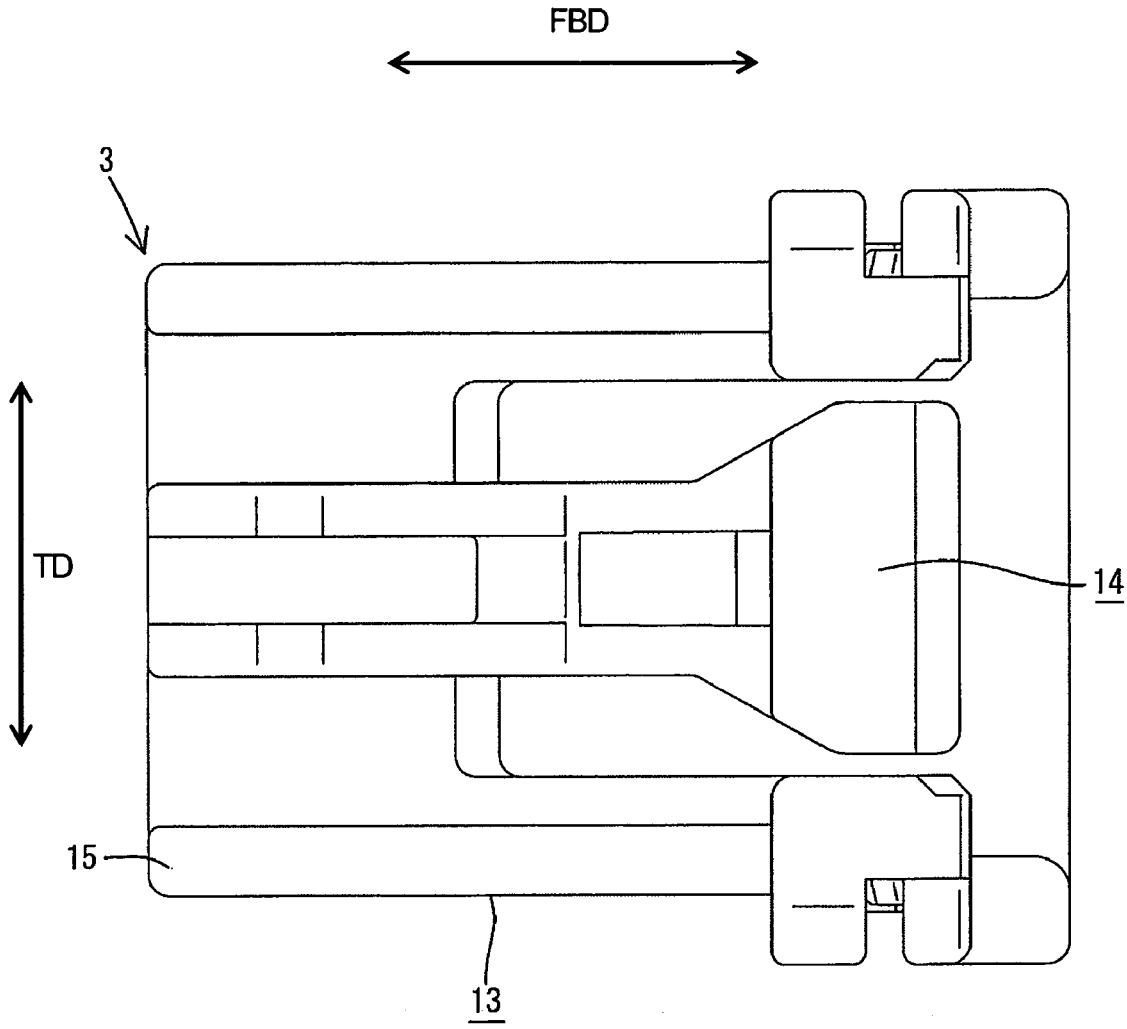
FIG. 3 is a top view of the connector housing.
Figure 11:
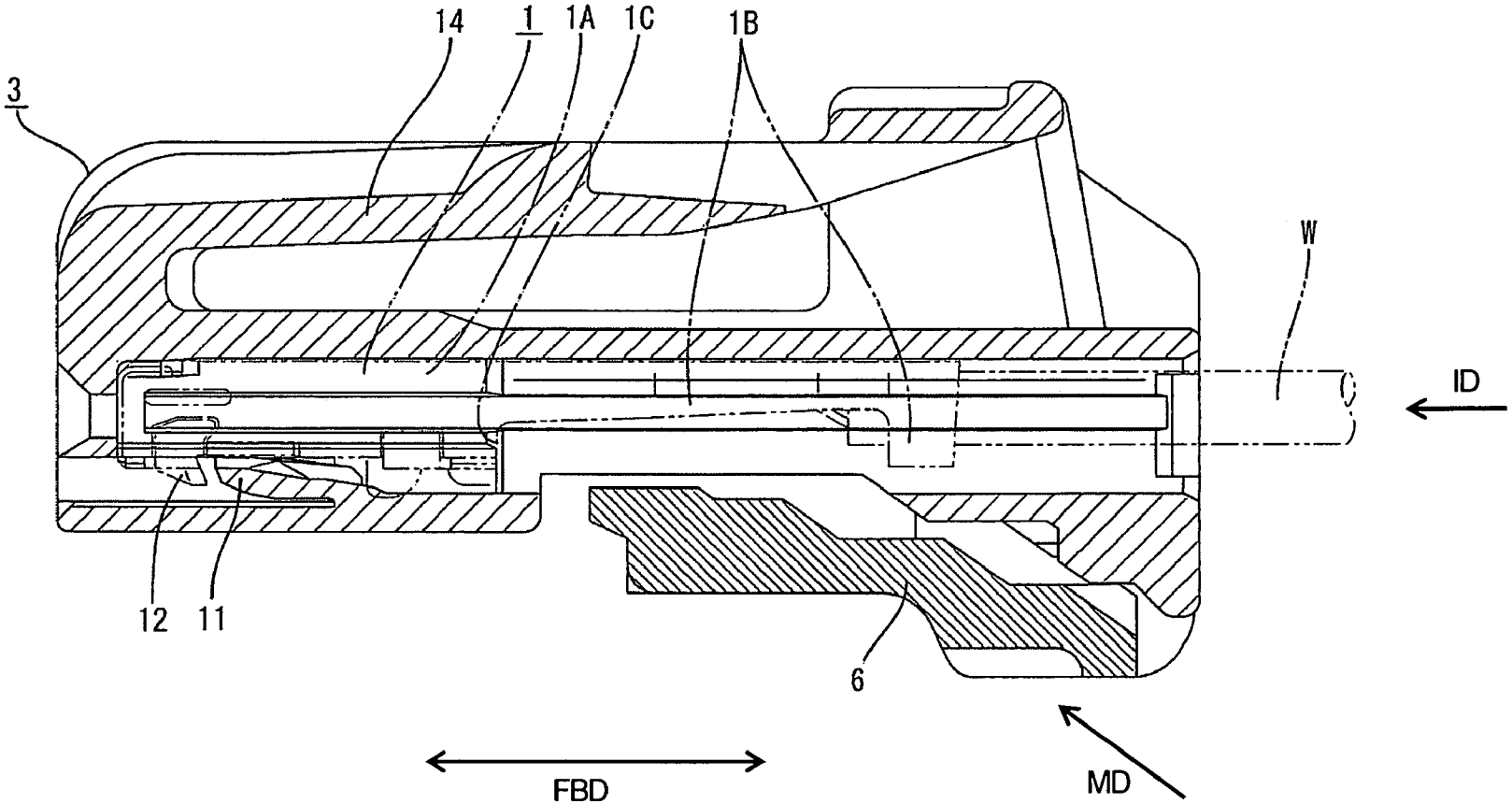
FIG. 11 is a side view in section showing the state where the retainer is held at the partial locking position.

The female housing 3 is formed unitarily of a synthetic resin and includes a flat block-shaped main portion 13, as shown in FIGS. 2 and 3. The main portion 13 is fittable into a receptacle of a mating male connector housing. A lock arm 14 is formed on the upper surface of the main portion 13 for locking the male and female housing together. Two protection walls 15 project up at the opposite sides of the lock arm 14. Six cavities 2 are arranged substantially side by side along the transverse direction TD of the main portion 13. Each cavity 2 extends through the main portion 13 in forward and backward directions FBD. The female terminal fittings 1 are inserted into the respective cavities 2 from behind and along an inserting direction ID. Resiliently deformable locks 11 are provided at the bottom surface of the respective cavities 2 and engage the locking pieces 12 of the female terminal fittings 1 from behind when the respective female terminal fittings 1 have been inserted to a proper position, as shown in FIG. 11.

Figure 1:
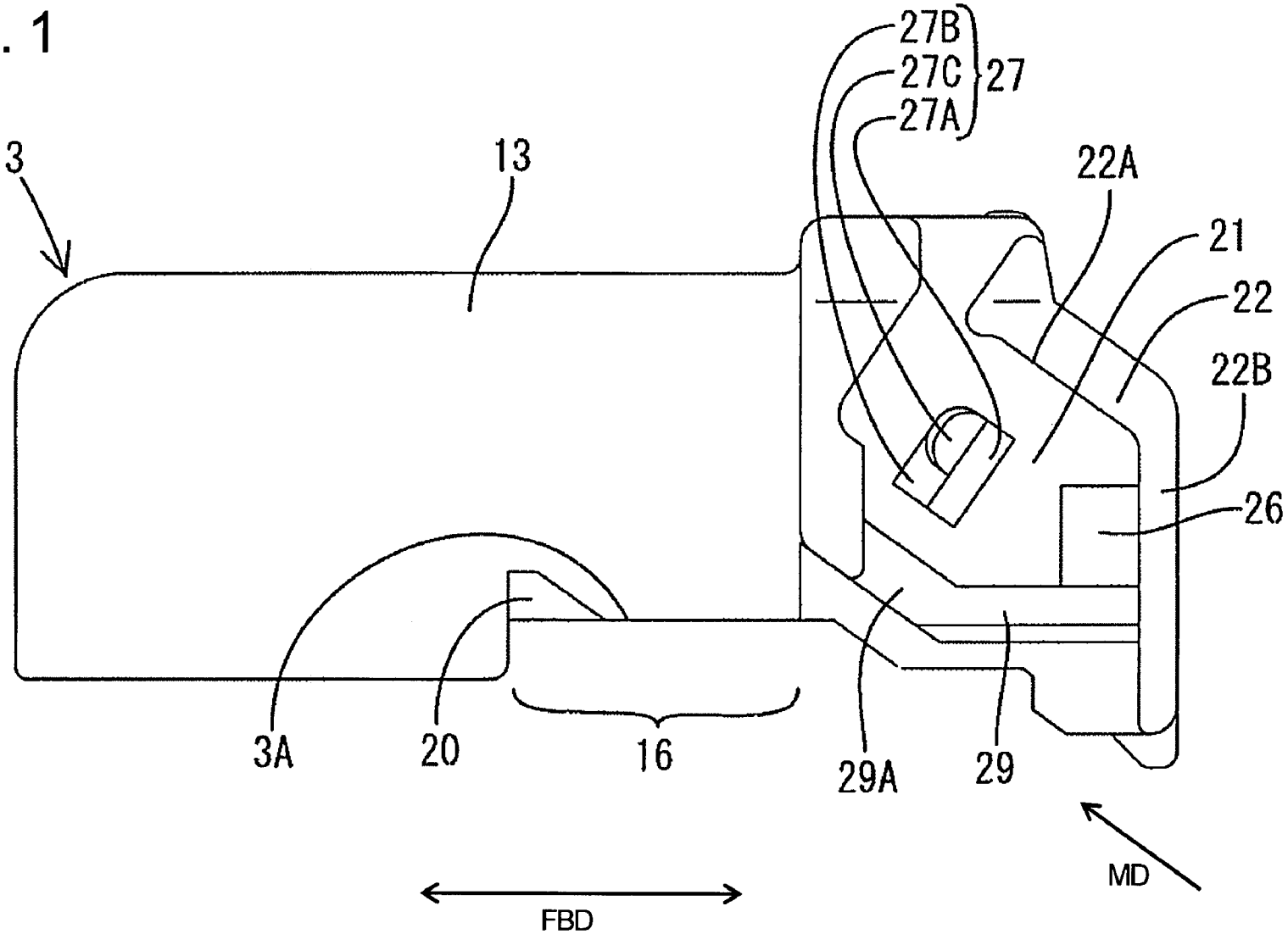
FIG. 1 is a side view of a connector housing.

The retainer 6 is mounted on the bottom of the female housing 3 to provide secondary locking of the female terminal fittings 1. A retainer mount recess 16 is formed in the bottom of the main portion 13 of the female housing 3 at a position slightly behind the longitudinal middle, as shown in FIG. 1. The retainer mount surface 16 is recessed across substantially the entire width of the main portion 13 and communicates with the cavities 2.

Retainer mounting surfaces 21 are formed on the opposite widthwise side surfaces at a rear of the main portion 13 and engage side plates 25 of the retainer 6 to mount the retainer 6. The retainer 6 is movable between a partial locking position and a full locking position. The female terminal fittings 1 are insertable into and withdrawable from the cavities 2 when the retainer 6 is at the partial locking position. However, the female terminal fittings 1 are retained by the retainer 6 when the retainer 6 is at the full locking position.

A locking edge 29 extends substantially along the forward and backward directions FBD at the bottom end of the retainer mounting surface 21. A locking step 26 is formed at an inner side of the rear end of the locking edge 29 and has a shorter projecting distance than the locking edge 29. On the other hand, the retainer 6 includes two plates 25 for holding the retainer mounting surfaces 21 from substantially opposite sides. Locking recesses 30 are formed at intermediate positions on inner surfaces of the side plates 25. The upper surfaces of the locking edges 29 engage the upper edges of the locking recesses 30 when the retainer 6 is at the partial locking position to prevent downward disengagement of the retainer 6 in a direction opposite to a mounting direction MD of the retainer 6. Auxiliary recesses 32 are formed continuously above the rear sides of the locking recesses 30 in the side plates 25 and are shallower than the locking recesses 30. The upper edges of the auxiliary recesses 32 engage the upper edges of the locking steps 26 when the retainer 6 is at the partial locking position and help the engagement of the locking recesses 30 and the locking edges 29.

Each retainer mounting surface 21 also has a construction for holding the retainer 6 at the partial locking position. Specifically, a peripheral wall 22 projects along the rear edge of each retainer mounting surface 21. A first guide surface 22A is formed at an upper part of the peripheral wall 22 and extends obliquely forward substantially parallel to a mounting direction MD of the retainer 6 to the housing 3. A vertical portion 22B is formed at a lower part of the peripheral wall 22. On the other hand, the rear edges of the side plates 25 of the retainer 6 are formed to fit closely to the first guide surfaces 22A and the vertical portions 22B when the retainer 6 is at the partial locking position.

Figure 8:
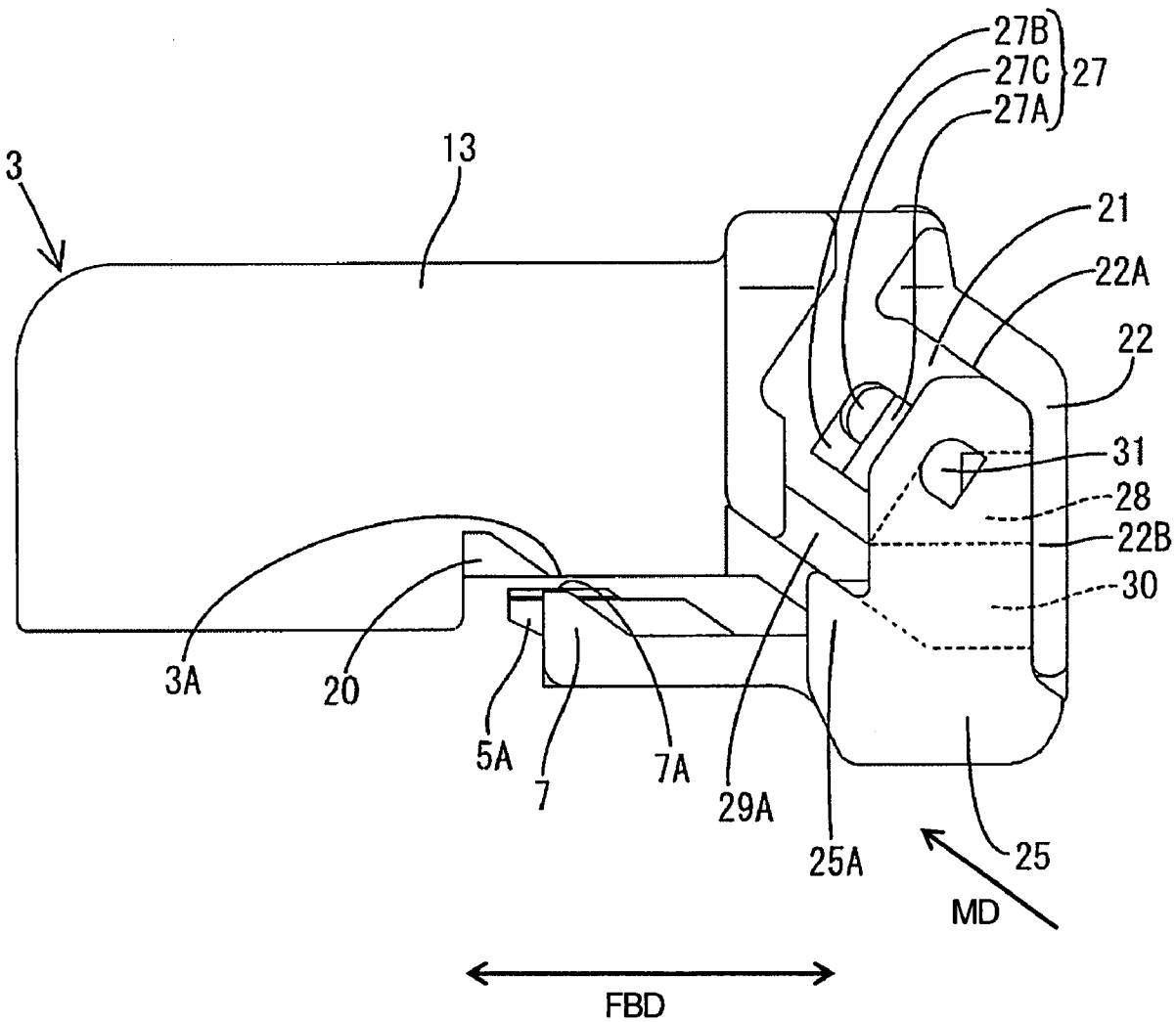
FIG. 8 is a side view showing a state where the retainer is held at a partial locking position.
Figure 9:
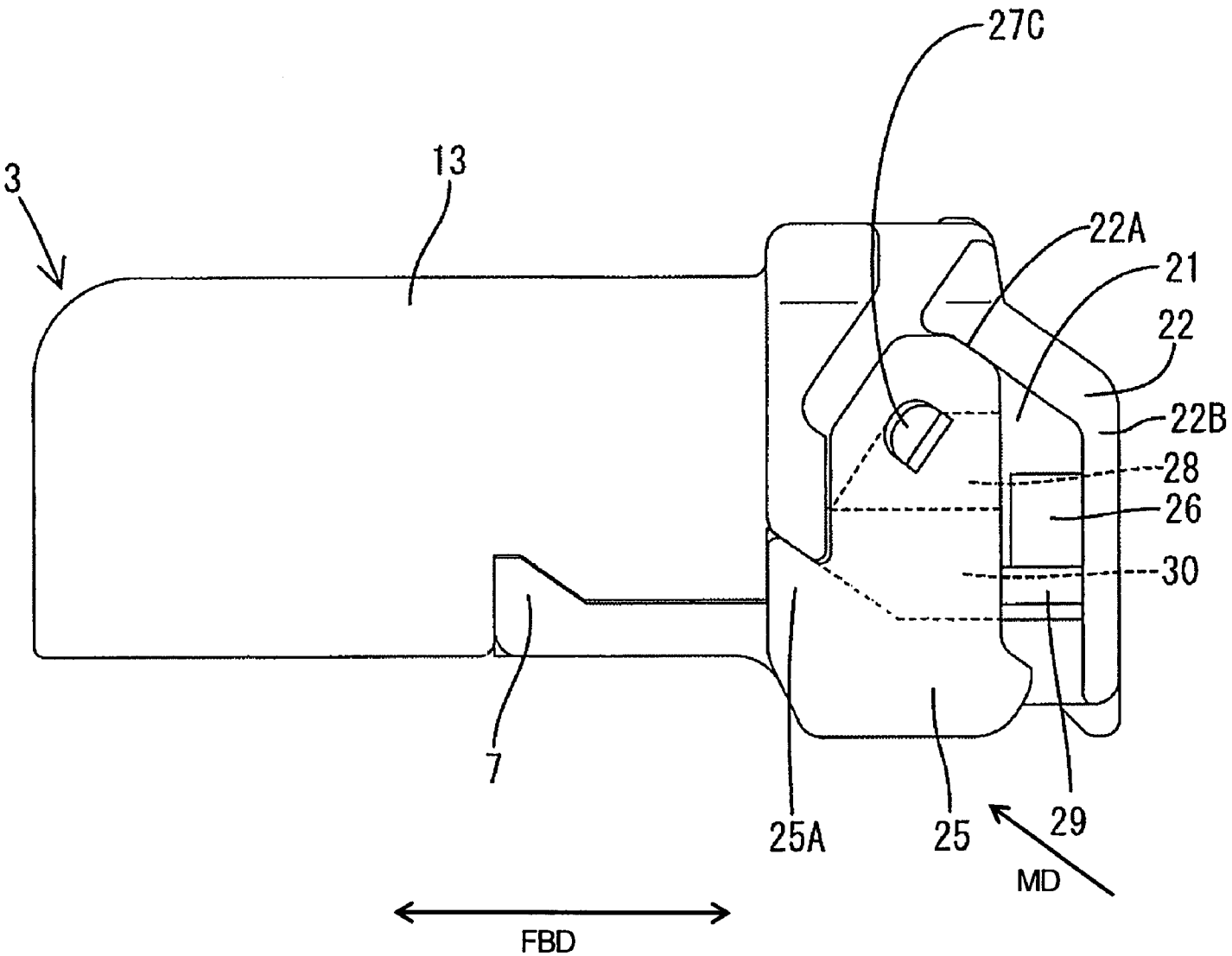
FIG. 9 is a side view showing a state where the retainer is held at a full locking position.

A full locking projection 27 is formed at an intermediate position of each retainer mounting surface 21. Each full locking projection 27 is obliquely up from the corresponding side plate 25, as shown in FIG. 8, when the retainer 6 is at the partial locking position. An upwardly inclined restricting slant 27A is formed at a side of the full locking projection 27 towards the side plate 25. The restricting slant 27A contacts the facing edge of the side plate 25 when the retainer 6 is at the partial locking position to prevent the retainer 6 from moving inadvertently to the full locking position. However, the side plates 25 deform away from one another when a force of a specified intensity or larger is exerted on the retainer 6 so that the retainer 6 can be moved towards the full locking position The restricting slants 27A merely function to set the locking force.

The first guide surface 22A of each peripheral wall 22 extends obliquely up substantially along the mounting direction MD of the retainer 6 and contacts the oblique upper edge of the corresponding side plate 25 when the retainer 6 is at the partial locking position, as shown in FIG. 8. A force can be exerted on the retainer 6 to move the retainer 6 from the partial locking position to the full locking position. As a result, the retainer 6 is guided in sliding contact with the first guide surfaces 22A towards the full locking position. A second guide surface 29A is formed on a front portion of the locking edge 29 of each retainer mounting surface 21 and is inclined substantially parallel with the first guide surface 22A to move the retainer 6 stably towards the full locking position. On the other hand, the bottom edge of the locking recess 30 of each side plate 25 contacts the bottom edge of the second guide surface 29A.

An extended portion 25A is at the bottom of the front end of each side plate 25, and the upper edge of the extended portion 25A extends from the front of the bottom edge of the locking recess 30 to extend an area of engagement of the retainer 6 with the female housing 3. As a result, the retainer 6 is held securely at the partial locking position. Additionally, the retainer 6 is guided securely from the partial locking position to the full locking position while the side plates 25 move onto the full locking projections 27 and terminal locking projections 5A on terminal lock 5 are inserted securely into the cavities 2.

Each full locking projection 27 has an auxiliary slant 27B that is substantially continuous with the restricting slant 27A at the opposite side. Each auxiliary slant 27B has a relatively moderate inclination. A locking protrusion 27C is adjacent the auxiliary slant 27B and has a substantially semicircular bulge on its outer periphery. On the other hand, a full locking hole 31 is formed at an upper part of each side plate 25, and is shaped in conformity with the locking protrusion 27C so that the locking protrusion 27C is fittable therein. An escaping recess is formed adjacent the full locking hole 31 in the inner surface of each side plate 25 for accommodating the restricting slant 27A and the auxiliary slant 27B. The full locking holes 31 receive the locking protrusions 27C when the retainer 6 reaches the full locking position. Thus, the side plates 25 restore resiliently to hold the retainer 6 at the full locking position.

The terminal lock 5 locks the female terminal fittings 1 at the full locking position. Each terminal lock 5 includes a bottom plate 5B that projects substantially forward from the bottom part of the housing locking portion 4. The bottom plate 5B is formed to close an opening in the bottom surface of the female housing 3 by forming the retainer mounting surfaces 21 when the retainer 6 is at the full locking position. Terminal locking projections 5A project on the upper surface of the bottom plate 5B in correspondence with the respective cavities 2. The terminal locking projections 5A are located outside the corresponding cavities 2 when the retainer 6 is at the partial locking position. However, the terminal locking projections 5A are in the corresponding cavities 2 when the retainer 6 is at the full locking position for engaging the rear surfaces of the jaws 1C of the female terminal fittings 1 to retain the female terminal fittings 1.

Substantially triangular restrictions 7 project unitarily at the front end of the opposite widthwise ends of the bottom plate 5B. The front edge of each restriction 7 extends from the front edge of the bottom plate 5B substantially vertically and substantially normal to the inserting direction ID when the retainer is in the second position. The rear edge of each restriction 7 is inclined to extend substantially along the moving direction MD of the retainer 6. Thus, the rear edge of each restriction 7 is substantially parallel to the first and second guide surfaces 22A, 29A. The tip of the restriction 7 is cut horizontally to form an abutment surface 7A. On the other hand, the retainer mount recess 16 is formed in the bottom surface of the female housing 3. Bottom end surfaces of partition walls between the respective cavities 2 and bottom end surfaces 3A of the opposite side walls of the female housing 3 along the width direction are exposed at the bottom surface of the female housing 3. When the retainer 6 is at the partial locking position, the abutment surfaces 7A are slightly below the bottom end surfaces 3A of the opposite side walls along the width direction and can be brought into abutment against the bottom end surfaces 3A. This abutment prevents an upward pushing force on the terminal lock 5 from moving the retainer 6 towards the female housing 3. Notches 20 are formed at the front ends of the bottom end surfaces 3A of the opposite side walls of the female housing 3 along the transverse direction TD and are configured to mate with the restrictions 7. Each notch 20 extends over substantially the entire thickness range of the corresponding bottom end surface 3A. The notches 20 avoid the interference of the restrictions 7 with the female housing 3 during movement of the retainer 6 from the partial locking position to the full locking position.

The retainer 6 is assembled with the female housing 3 to the partial locking position. At this time, the retainer 6 and the female housing 3 are positioned by holding the rear ends of the side plates 25 in contact with the front edges of the vertical portions 22B of the peripheral walls 22. The retainer 6 is pushed to cross over the bottom surface of the female housing 3. During this operation, the retainer 6 is pushed while the upper edges of the side plates 25 move onto the locking edges 29 to widen the spacing between the left and right side plate 25. The retainer 6 is pushed until the upper edges of the side plates 25 contact the first guide surfaces 22A. The side plates 25 then return to reduce the spacing therebetween. Thus, the locking edges 29 fit into the locking recesses 30 and the locking steps 26 fit into the auxiliary recesses 32. As a result, the downward disengagement of the retainer 6 away from the female housing 3 is prevented. Simultaneously, the side plates 25 are held tightly between the restricting slants 27A and the peripheral walls 22 to prevent the retainer 6 from moving forward or backward at the partial locking position.

After the retainer 6 is mounted at the partial locking position, the female terminal fittings 1 that have been connected with the wires W are inserted into the cavities 2 of the female housing 3 from behind and along the inserting direction ID. The locking piece 12 on the bottom surface of the substantially rectangular tube 1A presses the lock 11 at the front end of the bottom of the cavity 2 and deforms the lock 11 down and out. The lock 11 is restored resiliently when the locking piece 12 passes the lock 11 to achieve partial locking of the female terminal fitting 1 in the respective cavity 2.

At this partial locking position, the terminal locking projections 5A of the retainer 6 are below the bottom surfaces of the cavities 2. The terminal lock 5 could be pushed up from below. As a result, the retainer 6 would turn about the housing lock 4 and could cause the terminal locking projections 5A to enter the cavities 2. However, the abutment surfaces 7A of the restrictions 7 contact the bottom end surfaces 3A of the opposite side walls of the female housing 3 along the transverse direction TD and prevent the terminal locking projections 5A from entering the cavities 2 at the partial locking position of the retainer 6.

The entire retainer 6 is pushed further up and moves obliquely forward in the mounting direction MD due to the guiding action of the first and second guide surfaces 22A, 29A. At this time, parts of the side plates 25 before the full locking holes 31 move beyond the locking protrusions 27C of the full locking projections 27 and the side plates 25 return. Thus, the locking protrusions 27C fit into the full locking holes 31 to hold the retainer 6 at the full locking position. The terminal locking projections 5A are guided into the cavities 2 and engage the rear surfaces of the jaws 1C of the female terminal fittings 1. In this way, the female terminal fittings 1 are locked redundantly by the locks 11 and the retainer 6 and will not come out of the cavities 2. On the other hand, the oblique sides of the restrictions 7 move along the oblique sides of the notches 20 to fit the restrictions 7 in the notches 20 at the full locking position of the retainer 6.

The restrictions 7 are at the substantially opposite ends of the terminal lock 5. Thus, the terminal locking projections 5A will not enter the cavities 2 even if an upward pushing force acts on the terminal locking portion 5 from below while the retainer 6 is at the partial locking position. As a result, the reliability of partly locking the retainer 6 is improved without hindering the insertion of the female terminal fittings 1.

An attempt may be made erroneously to connect the male and female housings with the retainer 6 left partly locked. In such a case, if the terminal lock 5 could incline to permit the leading end thereof to enter the cavities 2, then the forcible connection of the male and female connector housings would be permitted even though the retainer 6 is left partly locked. However, inclination of the terminal lock 5 is prevented securely. Thus, the housings cannot be connected if the retainer 6 inadvertently is left at the partial locking position. Therefore, there is no possibility of leaving the housings incompletely connected.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention is applicable to connectors with cavities arranged at upper and lower stages and upper and lower retainers are inserted obliquely from above and below.

The above-described retainer is guided obliquely between the partial locking position and the full locking position. However, the retainer may be moved substantially normal to the longitudinal direction of the housing and substantially normal to the inserting direction ID of the terminal fittings into the housing. In such a case, the retainer has to be moved from the partial locking position to the full locking position while avoiding interference of the restricting portions and the housing. Thus, the retainer then may be pushed up after being moved forward or backward. However, this construction must move the retainer in two different directions from the partial locking position to the full locking position. If the retainer is moved along an oblique direction as in the foregoing embodiment, it is sufficient to move the retainer only in one direction, which leads to improved efficiently and a simpler construction.

The invention has been described with reference to a female connector. However, the invention is also applicable to male connectors.

The terminal fittings are locked doubly in the respective cavity 2 by the lock 11 and the retainer 7 in the above-described embodiment. However, the invention is also applicable to connectors in which the terminal fittings are locked only by a retainer.

What is claimed is:

1. A connector, comprising:

a housing with opposite front and rear ends and being formed with at least one cavity extending from the rear end substantially to the front end for receiving at least one terminal fitting, a retainer mount recess extending into the housing and communicating with the cavities;

at least one retainer having opposite front and rear ends, a housing lock at the rear end of the retainer and being engageable with the housing and at least one terminal lock projecting forward from the housing lock to lock the terminal fittings, the retainer being movable obliquely forward between a first position for permitting insertion and withdrawal of the terminal fittings into and from the housing and a second position for causing a locking projection of the terminal lock to enter the cavity to lock the respective terminal fitting; and a restricting portion formed on portions of the terminal lock facing the housing when the retainer is at the first position and being dimensioned for restricting inclination of the locking projection of the terminal lock in a direction to enter the cavity by being disengageably engaged with the housing when the retainer is at the first position, but being dimensioned to permit the locking projection to engage the terminal fitting when the retainer is at the second position.

2. The connector of claim 1, wherein the terminal lock is cantilevered substantially forward from the housing lock.

3. The connector of claim 1, wherein the retainer is movable relative to the housing between the first and second positions along a direction oblique to an inserting direction of the terminal fittings.

4. The connector of claim 1, wherein the housing is recessed to form an escaping portion into which the restricting portion fits when the retainer is moved to the second position.

5. The connector of claim 1, wherein the housing comprises a pair of retainer mounting surfaces to be engaged with respective side plates of the retainer to mount the retainer.

6. The connector of claim 5, wherein a peripheral wall projects substantially along each retainer mounting surface and the retainer and the housing are positioned by holding the side plates substantially in contact with portions of the peripheral walls.

7. The connector of claim 6, wherein the retainer is pushed while upper edges of the side plates move onto respective locking edges to widen the spacing between the side plates, wherein the retainer is pushed until the side plates contact guide surfaces.

8. The connector of claim 7, wherein restricting slants are provided on the housing (3) for preventing the retainer from inadvertently moving to the second position by being held substantially in contact with a facing edge of the side plate when the retainer is at the first position.

9. The connector of claim 1, wherein one of the housing and the retainer has at least one locking edge and the other has at least one locking recess, so that when the retainer is at the first position, the locking edges engaged the locking recesses to prevent disengagement of the retainer from the housing.

* * * * *